US005622165A

United States Patent [19]

Huang

[11] Patent Number: 5,622,165

[45] Date of Patent: Apr. 22, 1997

[54] SNORKEL DIVING DEVICE

[76] Inventor: Chun-Ming Huang, P.O. Box 1032, Tainan, Taiwan

[21] Appl. No.: 628,775

[22] Filed: Apr. 5, 1996

[51] Int. Cl.[6] ..... B63C 11/16

[52] U.S. Cl. ..... 128/201.11; 128/201.27; 128/201.28; 128/202.14

[58] Field of Search ..... 128/201.11, 201.27, 128/201.28, 202.14

[56] References Cited

U.S. PATENT DOCUMENTS

| | | | |
|---|---|---|---|
| 908,690 | 1/1909 | Neubert | 128/201.11 |
| 1,197,115 | 9/1916 | Fell et al. | 128/201.11 |
| 3,064,646 | 11/1962 | Miller | 128/201.11 |
| 3,370,586 | 2/1968 | Aragona et al. | 128/201.11 |
| 3,951,142 | 4/1976 | Martin | 128/201.11 |
| 4,061,140 | 12/1977 | Saito | 128/201.11 |
| 4,805,610 | 2/1989 | Hunt | 128/201.11 |
| 5,027,805 | 7/1991 | Kung | 128/201.11 |
| 5,297,545 | 3/1994 | Infante | 128/201.11 |
| 5,351,681 | 10/1994 | Hudson | 128/201.27 |

*Primary Examiner*—Aaron J. Lewis

[57] ABSTRACT

A snorkel diving device has a floating disc, a hard snorkel passing through the floating disc longitudinally, a snorkel casing covering the upper end of the hard snorkel, and a hose connecting the hard snorkel and a mouthpiece joint. The floating disc has an upper casing, a lower casing coupling with the upper casing, and a waterproof inner disc therein. The inner disc has a center through hole. The upper casing has an upper pipe and the lower casing has a lower pipe to be inserted in the center through hole to form a passage to receive the hard snorkel. The upper end of the hard snorkel is above the disc and covered by the snorkel casing. The snorkel casing which is generally in a cap shape has a plurality of gaskets therein.

4 Claims, 9 Drawing Sheets

SNORKEL DIVING DEVICE

BACKGROUND OF THE INVENTION

The invention relates to a snorkel diving device. More particularly, the invention relates to a snorkel device which has a special floating disc.

A conventional snorkel device contains a hard pipe and a mouthpiece at the end of the hard pipe. The upper end of the hard pipe is above the water level. The diver has to be aware that water may enter the pipe via the upper end of the pipe if the diver tries a deep diving. There are other types of snorkel diving device in U.S. Pat. No. 908,690 and U.S. Pat. No. 5,351,681. However, the floating disc may be broken if the floating disc bumps against a rock or a hidden reef. Therefore, water will enter the interior of the floating disc to risk the diver's life.

SUMMARY OF THE INVENTION

An object of the invention is to provide a snorkel device which can be steadily maintain above the water level so that the diver can dive deeper in water.

Another object of the invention is to provide a snorkel diving device which can prevent water from entering the snorkel diving device.

Accordingly, a snorkel diving device has a floating disc, a hard snorkel passing through the floating disc longitudinally, a waterproof snorkel casing covering the upper end of the hard snorkel, and a hose connecting the hard snorkel and a mouthpiece joint. The floating disc has an upper casing, a lower casing coupling with the upper casing, and a waterproof inner disc disposed between the lower casing and the upper casing. The inner disc has a center through hole. The upper casing has an upper pipe protruding downward. The lower casing has a lower pipe protruding upward. The upper pipe and the lower pipe are inserted in the center through hole to form a passage to receive the hard snorkel. The lower casing has a generally cone-shaped bottom so that the hollow disc can float on water level steadily. The upper end of the hard snorkel is above the disc and covered by the waterproof snorkel casing so that water cannot enter the hard snorkel. The waterproof snorkel casing which is generally in a cap shape has a plurality of gaskets therein. If the upper casing or the lower casing bumps against a rock or a hidden reef, the upper casing or the lower casing may be broken but the waterproof inner disc will not be broken. The inner disc is made of waterproof plastics. A first nut passes through the upper end of the hose. The lower end of the hard snorkel connects the upper end of the hose. The lower end of the hard snorkel has an external thread to engage with the first nut. A three-way mouthpiece joint has a mouthpiece, an inhale orifice and an exhale orifice, and a branch pipe connecting the mouthpiece and the exhale orifice. An inhale check valve is disposed in the inhale orifice. A valve pipe connects the exhale orifice. An exhale check valve is disposed in the valve pipe. A second nut passes through the lower end of the hose. The inhale orifice connects the lower end of the hose. The second nut engages with the outer periphery of the inhale orifice. A retaining clamp has a notch. The inner diameter of the retaining clamp matches the outer diameter of the hose. The retaining clamp has a C-shaped clamp ring to pinch the hose. A clip extends from the upper edge of the retaining clamp downward. If the mouthpiece is removed from the mouth of the diver, the mouthpiece joint and the hose remain in the area near the mask. The upper surface of the floating disc can be painted by fluorescent dyestuff so that the position of the diver can be identified.

DETAILED DESCRIPTION OF THE INVENTION

Figure 1:
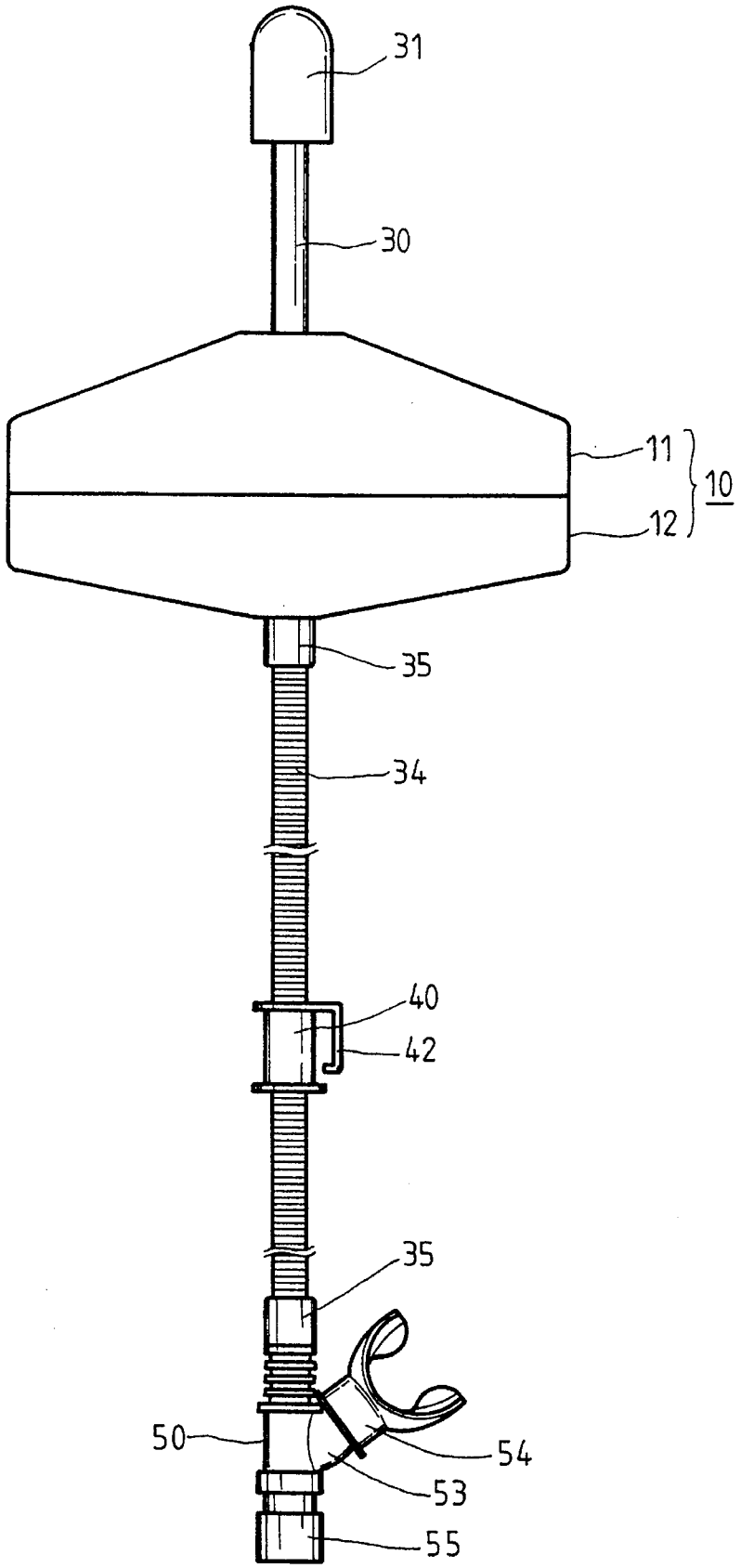
FIG. 1 is a plan view of a preferred embodiment in accordance with the invention.
Figure 2:
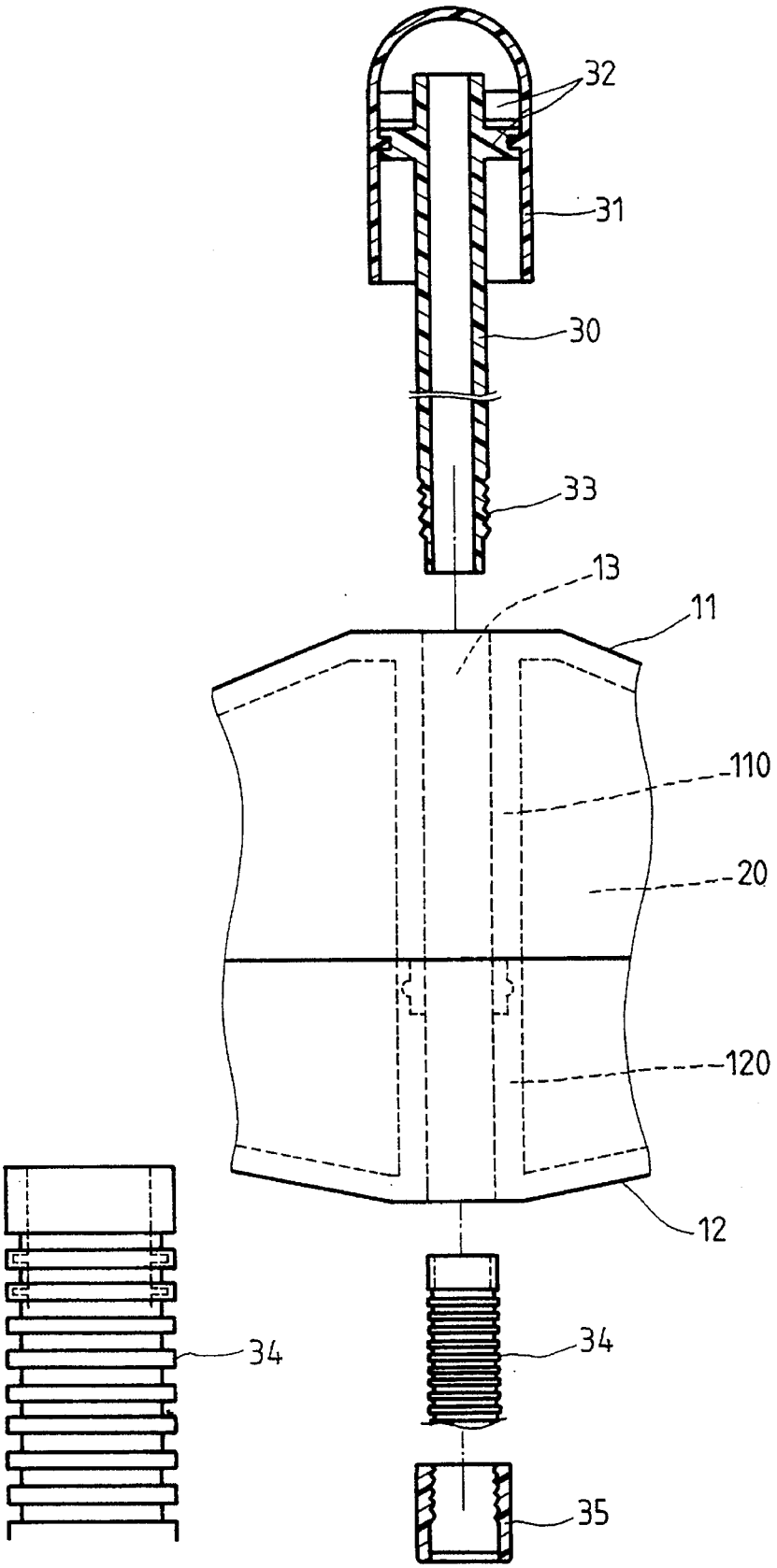
FIG. 2 is a partially cross-section exploded view of a floating disk and a hard snorkel.
Figure 3:
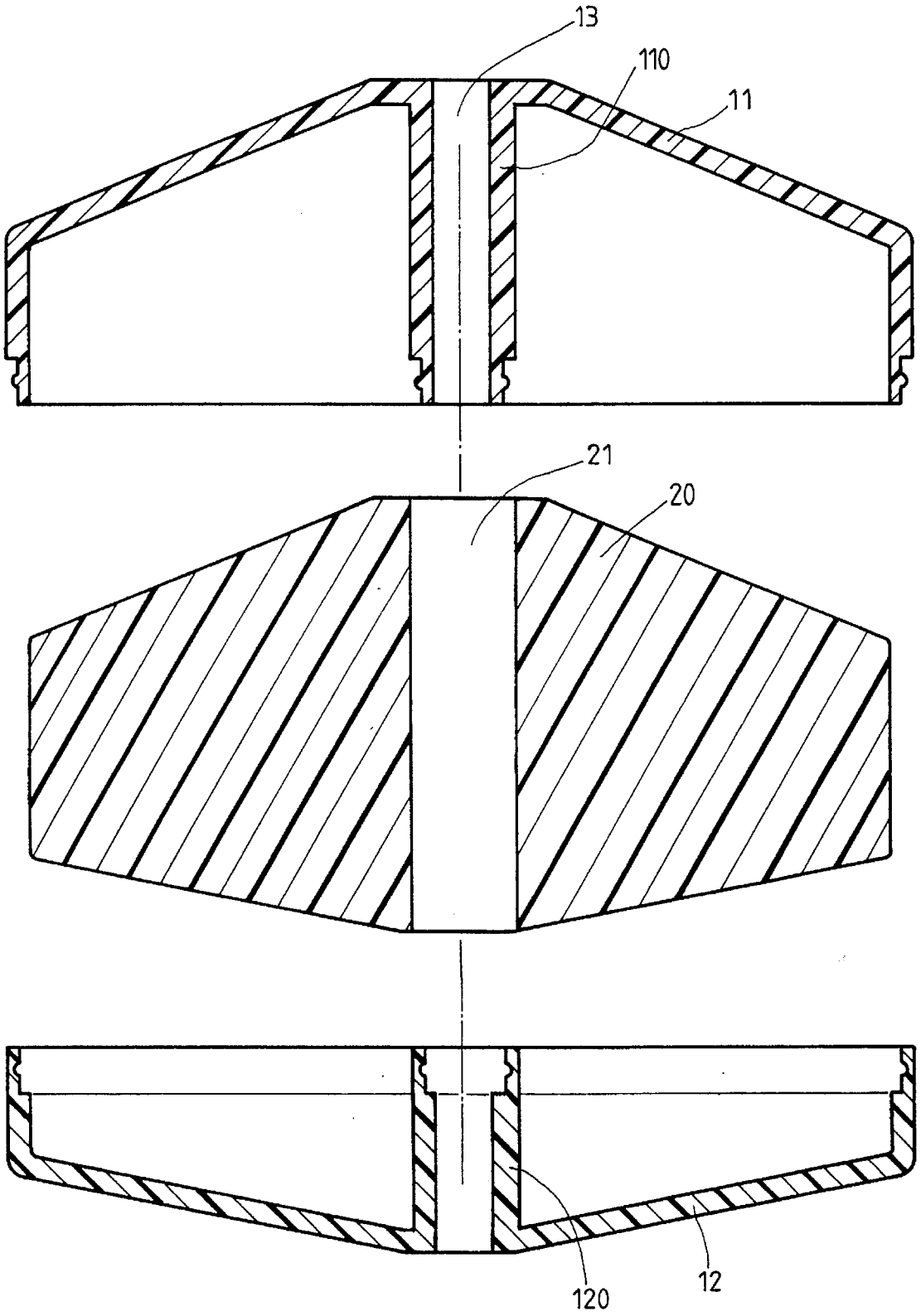
FIG. 3 is a cross-section exploded view of a floating disk.
Figure 6:
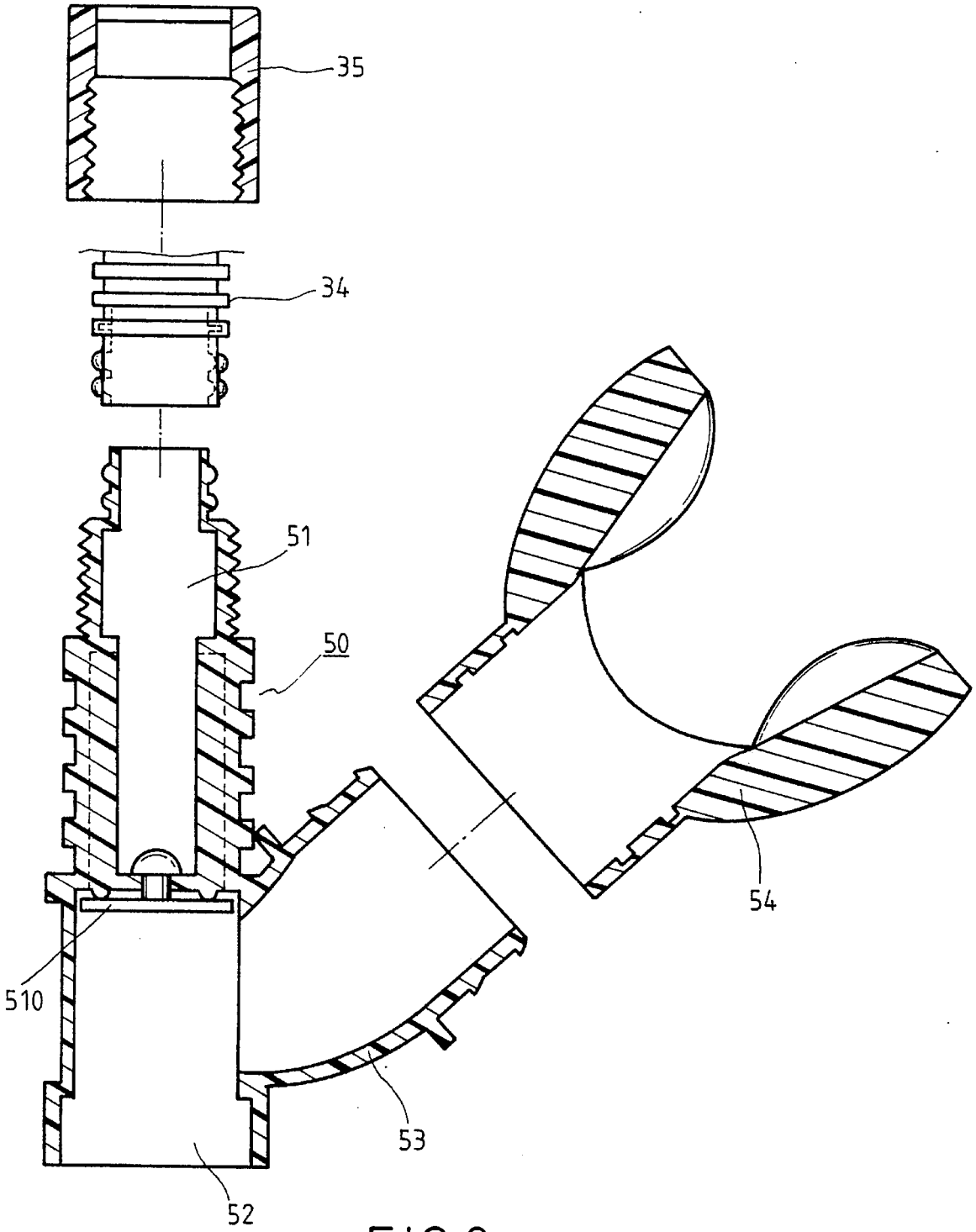
FIG. 6 is a sectional view of a mouthpiece joint.
Figure 7:
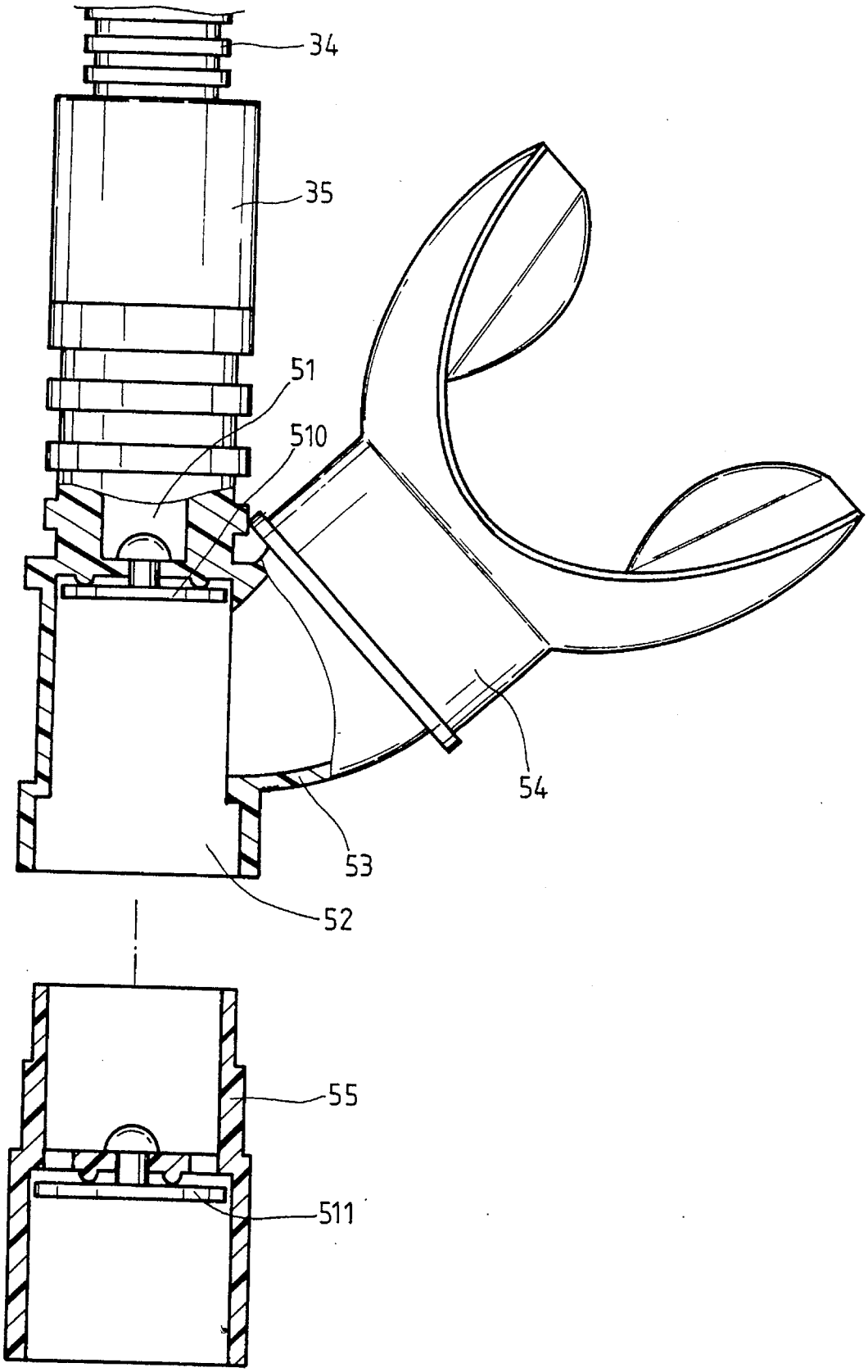
FIG. 7 is a sectional view of a mouthpiece joint and a valve pipe.

Referring to FIGS. 1 to 3 , a snorkel diving device has a floating disc 10, a hard snorkel 30 passing through the floating disc 10 longitudinally, a waterproof snorkel casing 31 covering the upper end of the hard snorkel 30, and a hose 34 connecting the hard snorkel 30 and a mouthpiece joint 50. The floating disc 10 has an upper casing 11, a lower casing 12 coupling with the upper casing 11, and a waterproof inner disc 20 disposed between the lower casing 12 and the upper casing 11. The inner disc 20 has a center through hole 21. The upper casing 11 has an upper pipe 110 protruding downward. The lower casing 12 has a lower pipe 120 protruding upward. The upper pipe 110 and the lower pipe 120 are inserted in the center through hole 21 to form a passage 13 to receive the hard snorkel 30. The lower casing 12 has a generally cone-shaped bottom so that the hollow disc 10 can float on water level steadily. The upper end of the hard snorkel 30 is above the disc 10 and covered by the waterproof snorkel casing 31 so that water cannot enter the hard snorkel 30. The waterproof snorkel casing 31 which is generally in a cap shape has a plurality of gaskets 32 therein. If the upper casing 11 or the lower casing 12 bumps against a rock or a hidden reef, the upper casing 11 or the lower casing 12 may be broken but the waterproof inner disc 20 will not be broken. The inner disc 20 is made of waterproof plastics. A first nut 35 passes through the upper end of the hose 34. The lower end of the hard snorkel 30 connects the upper end of the hose 34. The lower end of the hard snorkel 30 has an external thread 33 to engage with the first nut 35. A three-way mouthpiece joint 50 has a mouthpiece 54, an inhale orifice 51 and an exhale orifice 52, and a branch pipe 53 connecting the mouthpiece 54 and the exhale orifice 52. An inhale check valve 510 is disposed in the inhale orifice 51. Referring to FIGS. 6 and 7, a valve pipe 55 connects the exhale orifice 52. An exhale check valve 511 is disposed in the valve pipe 55. A second nut 35 passes through the lower end of the hose 34. The inhale orifice 51 connects the lower end of the hose 34. The second nut 35 engages with the outer periphery of the inhale orifice 51.

Figure 5:
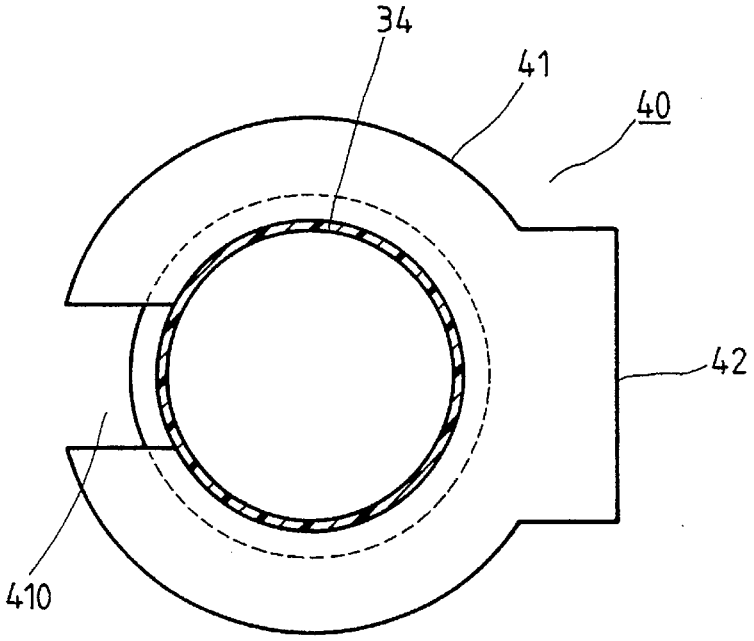
FIG. 5 is a top plan view of a hose and a retaining clamp.
Figure 4:
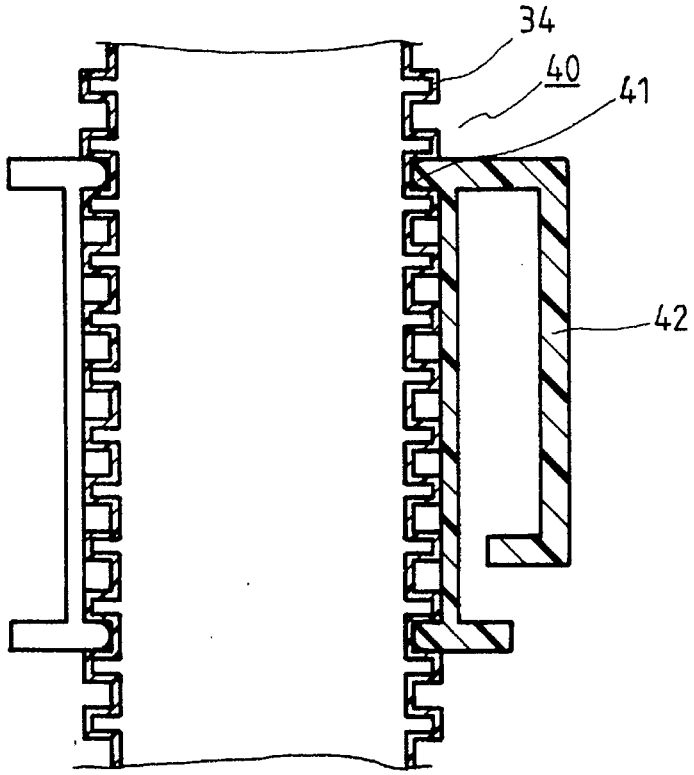
FIG. 4 is a sectional view of a hose and a retaining clamp.
Figure 9:
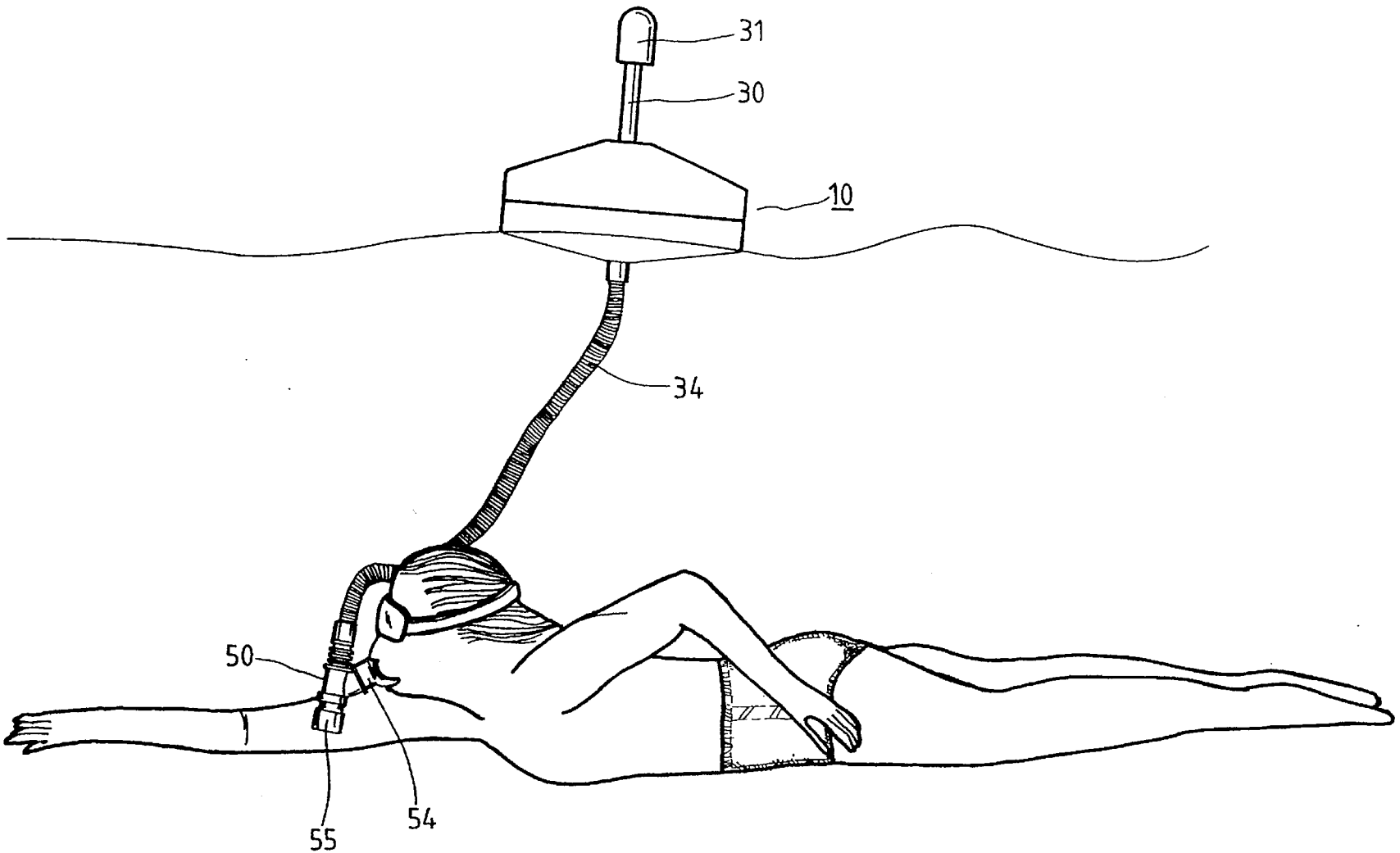
FIG. 9 is a schematic view illustrating the application of a snorkel diving device.
Figure 10:
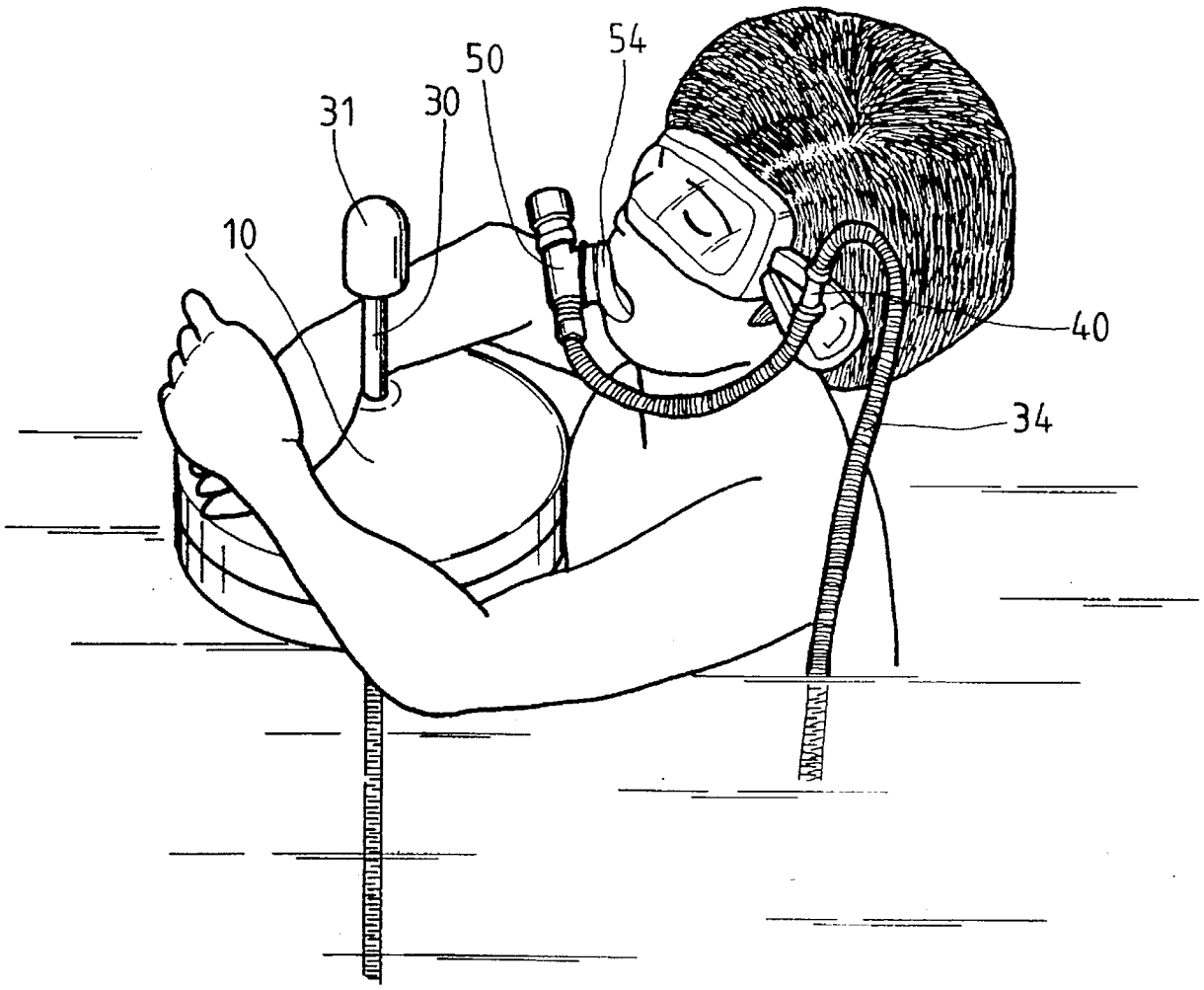
FIG. 10 is a schematic view illustrating a diver embracing a floating disc.

Referring to FIGS. 1, 4 and 5, a retaining clamp 40 has a notch 410. The inner diameter of the retaining clamp 40 matches the outer diameter of the hose 34. The retaining clamp 40 has a C-shaped clamp ring 41 to pinch the hose 34. A clip 42 extends from the upper edge of the retaining clamp 40 downward. The clip 42 can pinch a mask. If the mouthpiece 54 is removed from the mouth of the diver, the mouthpiece joint 50 and the hose 34 remain in the area near the mask. Referring to FIGS. 9 and 10, the upper surface of the floating disc 10 can be painted by fluorescent dyestuff so that the position of the diver can be identified. When the diver is tired or cramped, the diver can rest on the floating disc 10 by embracing the floating disc 10. Thus the floating disc 10 can provide a life-saving function in time.

Figure 8:
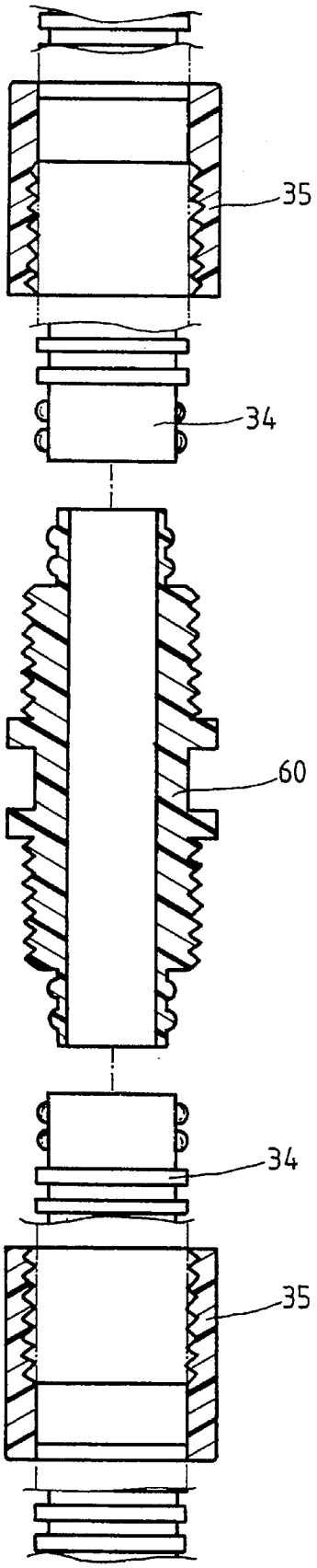
FIG. 8 iS a schematic view illustrating the connection of two hoses.

Referring to FIG. 8, a siamese joint 60 can joint two hoses 34 together via two nuts 35.

The invention is not limited to the above embodiment but various modification thereof may be made. It will be understood by those skilled in the art that various changes in form and detail may be made without departing from the scope of the invention.

What is claimed is:

1. A snorkel diving device comprising:

a floating disc having an upper casing, a lower casing coupling with said upper casing, and a waterproof inner disc disposed between said lower casing and said upper casing;

said inner disc having a center through hole;

said upper casing having an upper pipe protruding downward;

said lower casing having a lower pipe protruding upward;

said upper pipe and said lower pipe inserted in said center through hole to form a passage to receive a hard snorkel longitudinally;

an upper end of said hard snorkel above said disc and covered by a waterproof snorkel casing;

said waterproof snorkel casing which is generally in a cap shape having a plurality of gaskets therein;

a first nut passing through an upper end of a hose;

a lower end of said hard snorkel connecting said upper end of said hose;

said lower end of said hard snorkel having an external thread to engage with said first nut;

a three-way mouthpiece joint having a mouthpiece, an inhale orifice, an exhale orifice, and a branch pipe connecting said mouthpiece and said exhale orifice;

an inhale check valve disposed in said inhale orifice;

a valve pipe connecting said exhale orifice;

an exhale check valve disposed in said valve pipe;

a second nut passing through a lower end of said hose;

said inhale orifice connecting said lower end of said hose; and said second nut engaging with an outer periphery of said inhale orifice.

2. A snorkel diving device as claimed in claim 1, wherein said lower casing has a generally cone-shaped bottom.

3. A snorkel diving device as claimed in claim 1, wherein said inner disc is made of waterproof plastics.

4. A snorkel diving device as claimed in claim 1, wherein said snorkel diving device further comprises a retaining clamp which has a clip extending from an upper edge of said retaining clamp downward and a C-shaped clamp ring to pinch said hose.

* * * * *